US006524407B1

(12) United States Patent
Paul et al.

(10) Patent No.: US 6,524,407 B1
(45) Date of Patent: Feb. 25, 2003

(54) ALLOY BASED ON TITANIUM ALUMINIDES

(75) Inventors: Jonathan Paul, Colchester (GB); Fritz Appel, Geesthacht (DE); Richard Wagner, Bornheim-Merten (DE)

(73) Assignee: GKSS Forschungszentrum Geesthacht GmbH, Geesthact (DE)

( * ) Notice: Subject to any disclaimer, the term of this patent is extended or adjusted under 35 U.S.C. 154(b) by 0 days.

(21) Appl. No.: 09/550,906

(22) Filed: Apr. 17, 2000

Related U.S. Application Data

(63) Continuation-in-part of application No. PCT/DE98/02323, filed on Aug. 12, 1998.

(30) Foreign Application Priority Data

Aug. 19, 1997 (GB) ..... 197 35 841

(51) Int. Cl.[7] ..... C22C 14/00
(52) U.S. Cl. ..... 148/421; 420/418

(58) Field of Search ..... 148/421; 420/418

(56) References Cited

U.S. PATENT DOCUMENTS

| | | | | | |
|---|---|---|---|---|---|
| 5,080,860 | A | * | 1/1992 | Huang | 420/418 |
| 5,205,875 | A | * | 4/1993 | Huang | 148/421 |
| 5,213,635 | A | * | 5/1993 | Huang | 148/421 |
| 5,264,054 | A | * | 11/1993 | Huang | 148/670 |
| 5,324,367 | A | * | 6/1994 | Huang | 148/421 |
| 5,370,839 | A | * | 12/1994 | Masahashi et al. | 420/418 |
| 5,393,356 | A | * | 2/1995 | Singheiser | 148/421 |
| 5,447,680 | A | * | 9/1995 | Bowden | 419/4 |
| 5,503,798 | A | * | 4/1996 | Singheiser | 420/420 |

* cited by examiner

*Primary Examiner*—Roy King
*Assistant Examiner*—Andrew Wessman
(74) *Attorney, Agent, or Firm*—Klaus J. Bach

(57) ABSTRACT

In an alloy on the basis of titanium aluminides niobium is included in the alloy of titanium and aluminum.

3 Claims, 1 Drawing Sheet

ALLOY BASED ON TITANIUM ALUMINIDES

This is a continuation-in-part application of international application PCT/DE98/02323 filed Aug. 12, 1998 and claiming the priority of German application 197 38 841.1 filed Aug. 19, 1997.

BACKGROUND OF THE INVENTION

The invention relates to an alloy based on titanium aluminides including particularly titanium, aluminum and niobium.

It is known to utilize alloys on the basis of titanium aluminides for applications in which on one hand a low weight and on the other high material strength are required. Alloys on the basis of titanium-aluminides therefore replace in many cases already common super alloys on the basis of nickel which presently are still used for various components, for example in turbines for turbine blades.

The alloys on the basis of titanium aluminides do not have all the properties of the super alloys just mentioned, although they have a relatively low weight and high strength. Also, they cannot fulfill so far all the high technical standards set by the super alloys. An essential disadvantage of the known super alloys on the basis of titanium aluminides is that, beginning at an operating temperature of 700° C., their strength decreases noticeably. This occurs especially at low deformation speeds which is characteristic for material strains under creeping conditions.

It is therefore the object of the present invention to provide an alloy on the basis of titanium aluminides which does not have these disadvantages, that is, an alloy which also has a high temperature strength so that it is also suitable for the replacement of alloys on nickel basis. The alloy according to the invention should also be easy to manufacture and inexpensive and it should be relatively easily workable.

SUMMARY OF THE INVENTION

In an alloy on the basis of titanium aluminides, niobium is included in the alloy of titanium and aluminum.

In accordance with test results, the alloy according to the invention has a significantly increased strength up to a temperature range of 900° C. and higher, as compared to alloys on the basis of the titanium aluminide mixtures used so far.

It has also been found that the oxidation resistance of the alloy according to the invention is substantially greater than that of the alloy mixtures of this type used so far. Consequently, because of their substantially increased temperature resistance, the alloys according to the invention can provide for technical solution which were not achievable by the super alloys on the basis of nickel nor by the alloys on the basis of titanium aluminides:

In order to further increase the strength of the alloy, it is advantageous if the alloy composition of titanium, aluminum and niobium also includes components of boron and/or carbon. In this way the alloy becomes suitable for additional application such as for use in highpower turbines for jet propulsion in civil and military airplanes.

Experiments have indicated that it is advantageous to select a boron and/or carbon content in the alloy, which is lower than 0.5 atom %.

The content x of niobium in the alloy can vary preferably in such a way that $5 \leqq x \leqq 10$ with an alloy composition corresponding to Ti—45 Al—x Nb.

The invention will be described below with reference to two graphic representations shown in the accompanying drawings.

DESCRIPTION OF ALLOYS ACCORDING TO THE INVENTION

Figure 1:
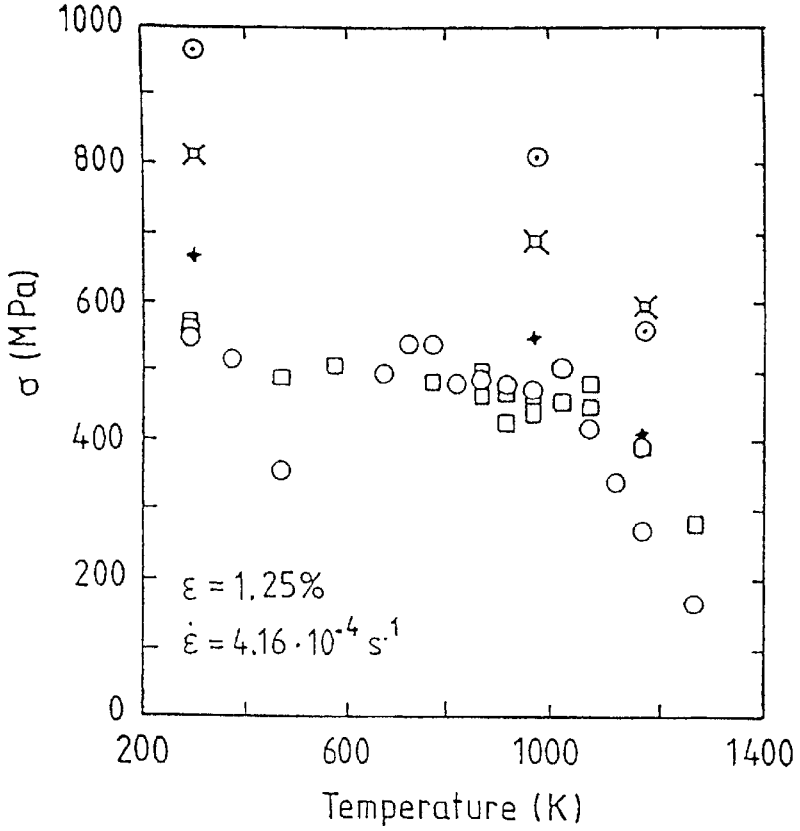
FIG. 1 shows the variations of the creep resistance over temperature of the alloy according to the invention and of known alloys on the basis of titanium aluminides as measured in compression stress tests.
Figure 2:
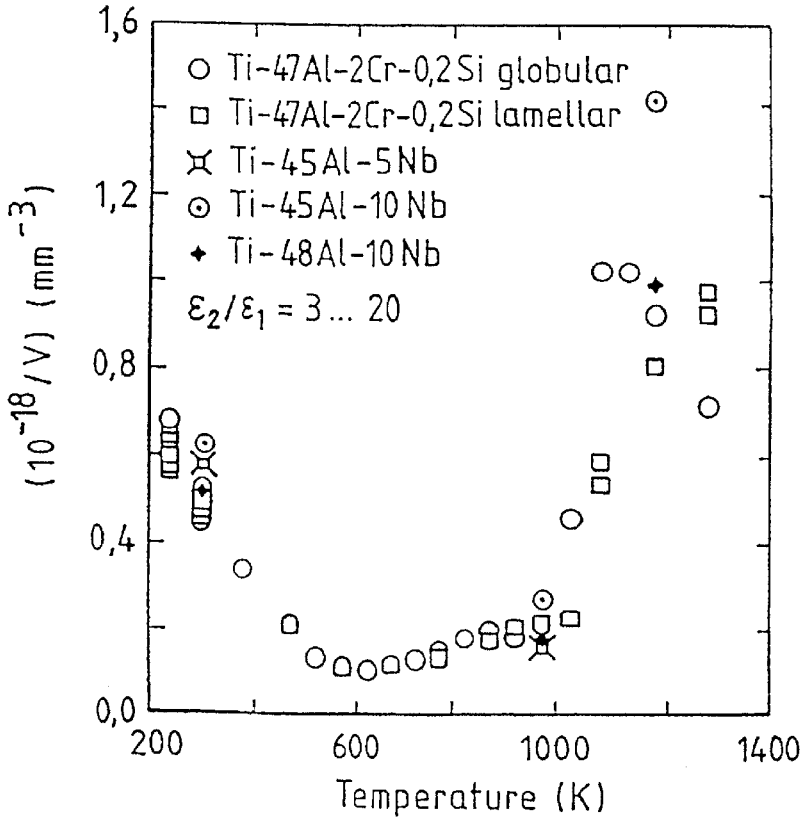
FIG. 2 shows the reciprocal activation volume (1/V) after a 1.25% plastic deformation under pressure of various alloys according to the invention and of known alloys on the basis of titanium aluminides of different compositions.

The figures show that the alloys according to the invention have substantially greater strength values than conventional alloys. At the same time, however, the reciprocal activation volume of the alloys according to the invention is comparable with that of conventional alloys. This means that the higher strength of alloys, which include niobium in addition to aluminum, remains also at high temperatures and low deformation velocities.

The alloys according to the invention with the composition Ti—45Al—x Nb with $5 \leqq x \leqq 10$ are manufactured using conventional metallurgical casting methods or known powder metallurgical techniques. They can be worked by hot forging hot pressing hot strand pressing and hot rolling.

In addition to the basic components of the alloy of titanium, aluminum and niobium, boron and/or carbon may be added in amounts of less than 0.5 atom % in order to increase the strength at high operating temperatures of the articles made from the alloys that is at operating temperatures of up to 900° C.

What is claimed is:

1. A high strength, high temperature resistant alloy consisting of, in an intermetallic γ-phase, 45 atom % aluminum, 5–10 atom % niobium, 0.01 to 0.5 atom % carbon, the remainder being exclusively titanium.

2. A high strength, high temperature resistant alloy consisting of, in an intermetallic γ-phase, 45 atom % aluminum, 5–10 atom % niobium, 0.01 to 1.0 atom % boron and the remainder being exclusively titanium.

3. A high strength, high temperature resistant alloy consisting of, in an intermetallic γ-phase, 45 atom % aluminum, 5–10 atom % niobium 0.01 to 1.0 atom % boron and carbon in combination, with neither of the two elements representing more than 0.5 atom %, and the remainder being exclusively titanium.

* * * * *